US011155107B2

(12) United States Patent
Asanuma

(10) Patent No.: US 11,155,107 B2
(45) Date of Patent: Oct. 26, 2021

(54) RECORDING MEDIUM CONVEYING APPARATUS AND IMAGE RECORDING APPARATUS

(71) Applicant: Konica Minolta, Inc., Tokyo (JP)

(72) Inventor: Tasuku Asanuma, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 58 days.

(21) Appl. No.: 16/672,864

(22) Filed: Nov. 4, 2019

(65) Prior Publication Data

US 2020/0139731 A1 May 7, 2020

(30) Foreign Application Priority Data

Nov. 6, 2018 (JP) ..... JP2018-208520

(51) Int. Cl.
*B41J 11/00* (2006.01)

(52) U.S. Cl.
CPC ..... *B41J 11/0085* (2013.01)

(58) Field of Classification Search
CPC ..... B41J 11/0085; B41J 11/007; B41J 13/08
See application file for complete search history.

(56) References Cited

FOREIGN PATENT DOCUMENTS

| | | | | |
|---|---|---|---|---|
| JP | 2015047798 A | 3/2015 | | |
| WO | 2018056245 A1 | 3/2018 | | |
| WO | WO-2018056245 A1 * | 3/2018 | ..... | B41J 11/02 |

* cited by examiner

*Primary Examiner* — Jannelle M Lebron
(74) *Attorney, Agent, or Firm* — Cantor Colburn LLP

(57) ABSTRACT

A recording medium conveying apparatus includes: a mount member having an outer peripheral surface on which a recording medium is placed; a ventilation member provided along part of an inner peripheral surface of the mount member; an air chamber having air permeability to/from the outer peripheral surface side of the mount member through the holes provided in the mount member and the ventilation member; a suction unit; and a side wall member having side wall surfaces covering part of side surfaces of the ventilation member. A buffer region that is not provided with the ventilation member is included in a ventilation member-disposed region enclosed by straight lines passing through the first surface, the second surface, and the pair of side wall surfaces, in an arbitrary cross section that intersects the pair of side wall surfaces across the ventilation member and is perpendicular to the first surface.

15 Claims, 7 Drawing Sheets

RECORDING MEDIUM CONVEYING APPARATUS AND IMAGE RECORDING APPARATUS

CROSS REFERENCE TO RELATED APPLICATION

The present invention claims priority under 35 U.S.C. § 119 to Japanese Patent Application No. 2018-208520, filed Nov. 6, 2018, the entire content of which is incorporated herein by reference.

BACKGROUND

Technological Field

The present invention relates to a recording medium conveying apparatus and an image recording apparatus.

Description of the Related Art

Conventionally, in an image recording apparatus that applies a color material such as ink or toner from a recorder to a recording medium and records images on the recording medium, a recording medium conveying apparatus has been used which is provided with a recording medium placed on the outer peripheral surface of an loop mount member such as a conveyor belt or conveyor drum that circles along a predetermined circulation path and conveys the recording medium. This recording medium conveying apparatus involves a technique in which an air chamber is provided on the inner peripheral surface side of the mount member and the air on the outer peripheral surface side of the mount member is sucked through holes and the air chamber provided in the mount member, whereby the recording medium is attracted and fixed on the outer peripheral surface.

There is another technique in which a ventilation member such as a porous body is provided along the inner peripheral surface of the mount member to support the mount member, so that the warpage of the mount member due to the negative pressure in the air chamber caused by the suction is suppressed (for example, Japanese Patent Laid-Open No. 2015-47798). Further, in this technique, at least a part of the side surface of the ventilation member is covered with a side wall member composed of a part of the housing or the like, so that air flows into the air chamber from the side surface of the ventilation member, whereby a reduction in the attraction of the recording medium and the displacement of the ventilation member can be suppressed (for example, International Publication WO2018/056245).

SUMMARY

However, if the temperature of the ventilation member rises due to friction between the mount member that circulates and the ventilation member, depending on the combination of a side wall member and the material of the ventilation member, the expansion of the ventilation member is hindered by the sidewall member, which causes the warpage of the ventilation member and impairs the flatness of the surface of the mount member. As a result, the problem arises that the recording medium cannot be properly conveyed because the recording medium is conveyed while being warped or the attraction of the recording medium becomes non-uniform.

An object of the present invention is to provide a recording medium conveying apparatus and an image recording apparatus that can convey a recording medium appropriately.

To achieve at least one of the abovementioned objects, a recording medium conveying apparatus according to one aspect of the present invention includes: a loop mount member having an outer peripheral surface on which a recording medium is placed; a driver unit that circulates the mount member along a predetermined circulation path; a ventilation member provided along at least part of an inner peripheral surface of the mount member; an air chamber provided on the opposite side of the ventilation member from the side in contact with the mount member, and having air permeability to/from the outer peripheral surface side of the mount member through the holes provided in the mount member and the ventilation member; a suction unit that sucks air in the air chamber; and a side wall member having side wall surfaces covering at least part of side surfaces of the ventilation member, the side surfaces joining a first surface that is in contact with the mount member and a second surface that is adjacent to the air chamber, wherein a buffer region that is not provided with the ventilation member is included in a ventilation member-disposed region enclosed by straight lines passing through the first surface, the second surface, and the pair of side wall surfaces, in an arbitrary cross section that intersects the pair of side wall surfaces across the ventilation member and is perpendicular to the first surface.

BRIEF DESCRIPTION OF THE DRAWINGS

The effects and features of one or more aspects of the present invention will be more fully understood from the detailed description set forth below and accompanying drawings. However, these are not intended to limit the present invention, wherein.

DETAILED DESCRIPTION OF EMBODIMENTS

Embodiments of a recording medium conveying apparatus and an image recording apparatus of the present invention will be described below with reference to the accompanying drawings. However, the present invention is not limited to the content of the following disclosure.

First Embodiment

Figure 1:
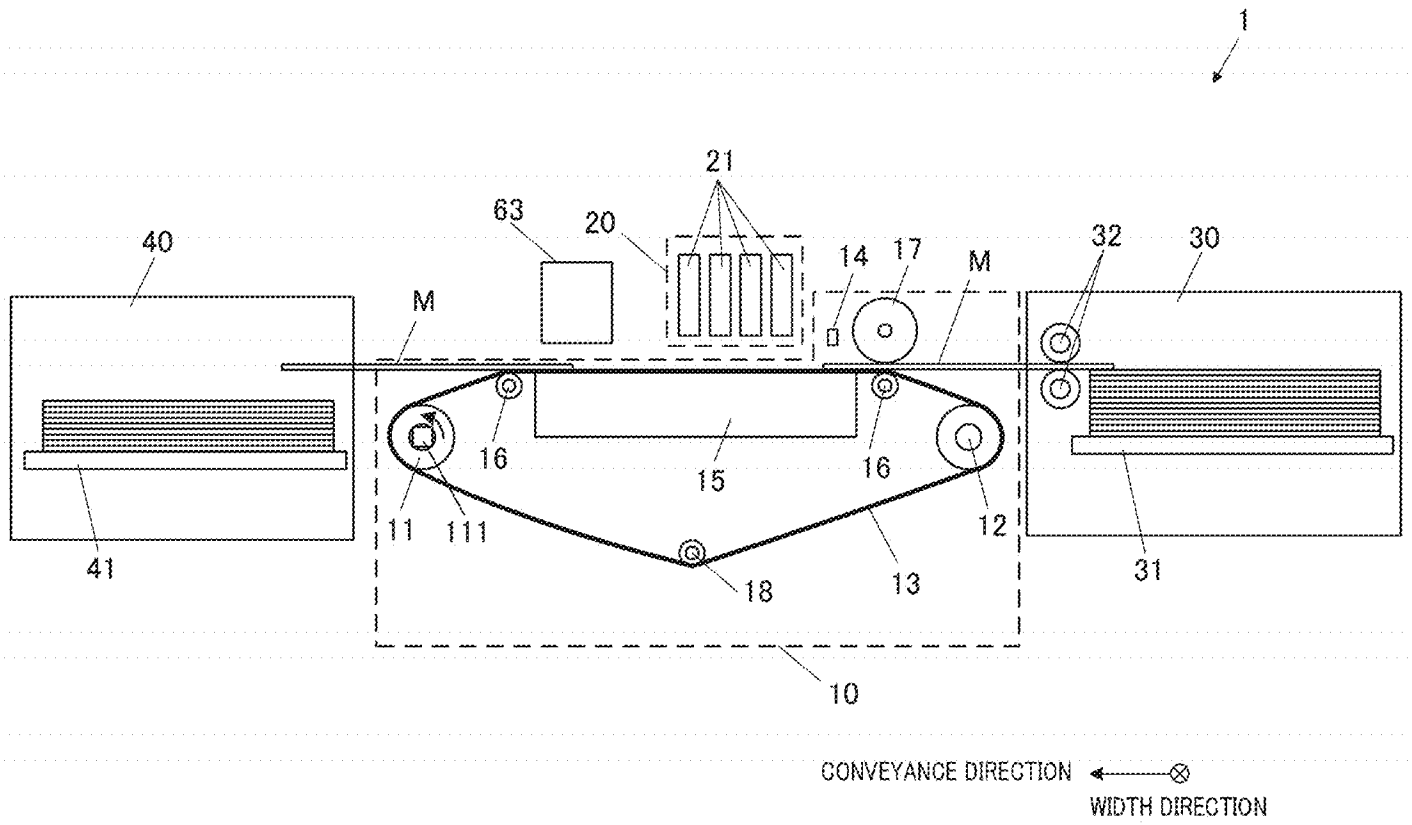
FIG. 1 is a diagram showing the overall configuration of a conveyor and an inkjet recording apparatus.

FIG. 1 is a diagram showing the overall configuration of a conveyor 10 (recording medium conveying apparatus) and an inkjet recording apparatus 1 (image recording apparatus) including the conveyor 10, according to the first embodiment of the present invention.

The inkjet recording apparatus 1 includes a medium supply unit 30, a conveyor 10, an image recorder 20, a medium discharge unit 40, and an ultraviolet radiator 63.

The medium supply unit 30 includes a placement tray 31 and a medium output unit 32.

The placement tray 31 is a plate-like member on which various individual recording media M (objects to be conveyed) such as sheets, cardboard, corrugated cardboard, and resin plates can be stacked for placement and the recording media M are delivered to the conveyor 10 sequentially from the top. The placement tray 31 is movable in the vertical direction, and is held in a position where the uppermost recording media M are delivered to the conveyor 10 in accordance with the total weight or the like of the placed recording media M. The degree of change in the height of the placement tray 31 may be adjustable according to the type of the recording media M by setting or the like. Large recording media M having a width of about 800 mm in a direction perpendicular to the drawing of FIG. 1 (width direction) and a length of about 1000 mm in a direction perpendicular to the width direction can be placed on the placement tray 31 according to this embodiment, and the inkjet recording apparatus 1 is configured to be able to convey the recording media M having such a size.

The medium output unit 32 includes, for example, rotatable rollers that sandwich a recording medium M to be delivered out, from above and below, and delivers the recording medium M, here, in the horizontal direction. The two rollers that sandwich the recording medium M move with a variable width according to the thickness of the recording medium M.

The medium output unit 32 may further include an endless delivery belt, two rollers across which the delivery belt is bridged, and other parts for supporting and delivering the recording medium M to immediately before a press roller 17 while the recording medium M is at the same level as the upper surface of the support and suction unit 15.

The conveyor 10 receives the recording medium M from the medium supply unit 30 and delivers it to the medium discharge unit 40. The conveyor 10 includes a driver roller 11, a driven roller 12, a conveyor belt 13 (mount member), a medium detector 14, a support and suction unit 15, a guide roller 16, a press roller 17, and a tension roller 18.

The conveyor belt 13 is a loop (endless) belt-like member and is, here, a steel belt. The steel belt may be composed of, for example, stainless steel or aluminum alloy, such as SUS304 and SUS631, having a thickness of about 0.3 mm. The steel belt is provided with a large number (a plurality) of circular holes 13*a* (FIG. 3) having a diameter of about 2 mm so as to have an aperture ratio of about 50% so that air can pass therethrough.

The conveyor belt 13 is bridged across the driver roller 11 and the driven roller 12 (hereinafter collectively referred to as the conveyor rollers 11 and 12), and is provided so as to be movable along a circulation path around the conveyor rollers 11 and 12. In other words, with the driver roller 11 rotating according to rotational drive operation by the conveyance motor 111 (driver unit), the conveyor belt 13 (and its outer peripheral surface) circulates along the circulation path around the conveyor rollers 11 and 12 according to the rotation speed and the rotation direction. Here, when the driver roller 11 rotates counterclockwise in the plane of FIG. 1, the conveyor belt 13 moves in the normal conveyance direction of the recording medium M (the travel direction of the circular movement). A recording medium M delivered from the medium supply unit 30 is placed on the outer peripheral surface of the conveyor belt 13, and the recording medium M is conveyed as the conveyor belt 13 moves.

The medium detector 14 detects whether or not the recording medium M is placed. The medium detector 14 has, for example, an radiator that irradiates the outer peripheral surface of the conveyor belt 13 with light of a predetermined wavelength, and a detection unit that detects irradiation light according to the presence or absence of the recording medium M on the conveyor belt 13 in a position between the press roller 17 and the head units 21 on the conveyance path of the recording medium M, and detects the presence or absence of the recording medium M or the leading position of the recording medium M according to the difference in reflection intensity detected by the detection unit. In addition, since the detection units are provided in two positions different in the width direction orthogonal to the conveyance direction in a plane parallel to the plane of conveyance of the recording medium M, the inclination of the leading end of the recording medium M may be detectable. These detections by the medium detector 14 control the timing of ink ejection by the image recorder 20, and prevents troubles such as clogging of the recording medium M due to the abnormality of the conveyance of the recording medium M, and adhesion of ink to the outside of the recording medium M (for example, the outer peripheral surface of the conveyor belt 13).

Figure 2:
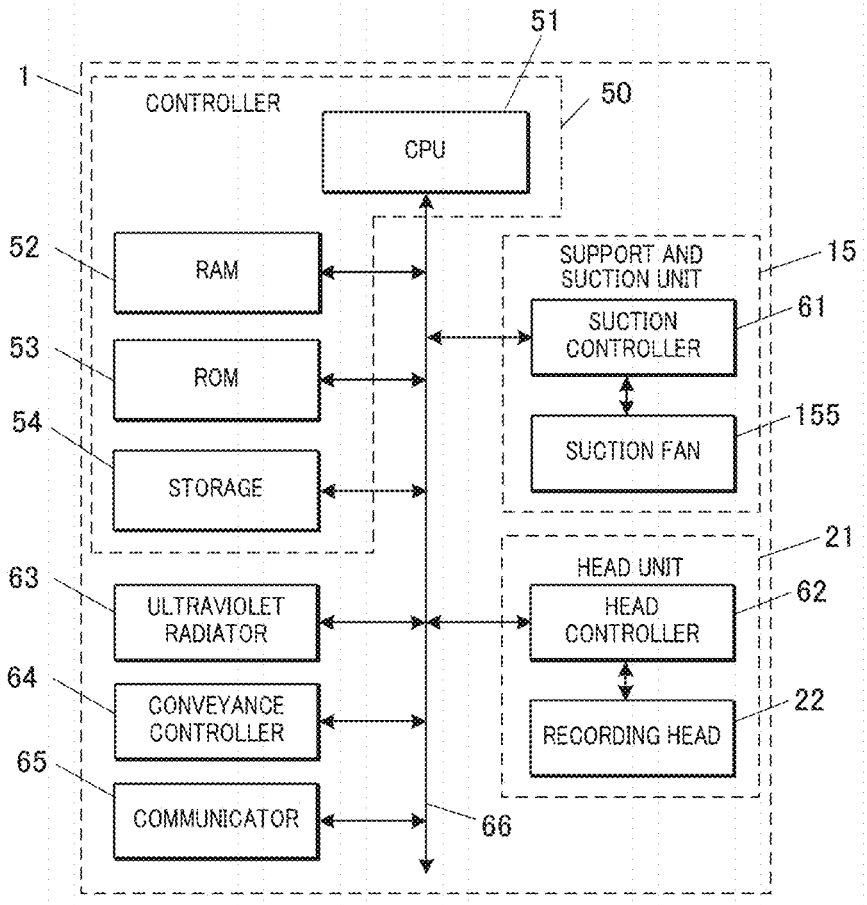
FIG. 2 is a block diagram showing the main functional configuration of the inkjet recording apparatus.

The support and suction unit 15 supports, with a plane surface (here, a horizontal surface) (hereinafter referred to as a support surface), the inner peripheral surface of the conveyor belt 13 (the surface in contact with the conveyor rollers 11 and 12) including the recording medium M to be conveyed, that is, a portion of the outer peripheral surface of the conveyor belt 13 facing the ink discharge surfaces of the head units 21 in the section between the two conveyor rollers 11 and 12 of the conveyor belt 13. The support and suction unit 15 attracts the recording medium M placed on the outer peripheral surface of the conveyor belt 13 onto the outer peripheral surface, by sucking air adjacent to the outer peripheral surface of the conveyor belt 13 through holes 13*a* in the conveyor belt 13 through a suction fan 155 (FIG. 2). The detailed configuration of the support and suction unit 15 will be described later.

Regarding the travel direction of the conveyor belt 13 (the direction of conveyance of the recording medium M), guide rollers 16 are provided upstream and downstream from the support and suction unit 15, respectively. The two guide rollers 16 support the conveyor belt 13 in position outer than both ends of the support surface. Each of the guide rollers 16 supports the conveyor belt 13 at substantially the same height as the support surface of the support and suction unit 15, and guides the travel operation while the conveyor belt 13 circulates.

The press roller 17 is a roller that is rotatably provided in a position facing the upstream guide roller 16 with the conveyor belt 13 therebetween. Upstream along the conveyance direction from the position where ink is discharged onto the recording medium M, in order to suppress lifting of the recording medium M, which is delivered from the medium supply unit 30, from the conveyor belt 13, especially curling (winding) of the leading end portion and the like to ensure attraction, the press roller 17 pressurizes (presses) it against the conveyor belt 13 with an appropriate pressure and guides it along the conveyor belt 13. The press roller 17 is configured so that the distance from the conveyance surface of the conveyor belt 13 is variable according to conditions such as the thickness of the recording medium M to be conveyed.

The tension roller 18 pressurizes a portion of the conveyor belt 13 from the side on which the outer peripheral surface of the conveyor belt 13 does not face the head units 21 between the two conveyor rollers 11 and 12, that is, the inner peripheral surface side, in the position where the conveyor belt 13 is in the middle of moving from the driver roller 11 to the driven roller 12, thereby giving appropriate tension. The positions of the tension roller 18 are adjustable in the vertical direction upward and downward in two positions different in the width direction, for example, at both ends, and the tension roller 18 corrects meandering caused by uneven tension applied to the conveyor belt 13 by the support and suction unit 15 or the like and so that the conveyor belt 13 and the recording medium M normally move in the conveyance direction.

The image recorder 20 includes one or more of, in this case, four head units 21 (recorders) that eject ink (coloring material). The surface of each head unit 21 that faces the support surface (recording medium M) of the support and suction unit 15 is an ink ejection surface in which nozzle openings are provided, and ejects ink so that it is landed on the recording medium M conveyed on the support surface of the support and suction unit 15 through the conveyor belt 13. Each head unit 21 has one or more recording heads 22 (FIG. 2) that have nozzle openings in a predetermined array and perform operations related to ink ejection from the nozzle openings. The area of the head unit 21 where the nozzles are arranged along the width direction covers the area of the recording medium M where an image is recorded along the width direction. The head unit 21 is used in a fixed position during recording of an image, and sequentially ejecting ink at predetermined intervals (intervals along the conveyance direction) to positions different in the conveyance direction according to the conveyance of the recording medium M allows the image to be recorded by the single-pass system.

Here, the four head units 21 are connected to ink tanks (not shown) of the respective colors of cyan (C), magenta (M), yellow (Y), and black (K) and eject ink of these respective colors of CMYK.

The ink used in this embodiment is a phase change ink that changes phases between the gel state and the sol state depending on the temperature, and is an ultraviolet curable ink in which the viscosity increases due to the progress of a curing reaction upon irradiation with ultraviolet rays. The ink of this embodiment becomes a sol having a viscosity suitable for ejection when heated to 70° C. From the nozzles of the head unit 21, ink that has been heated to a sol by a heater provided in the head unit 21 is ejected, and the ink that has landed on the recording medium M is rapidly transformed into a gel by cooling.

The ink used in this embodiment contains a photopolymerizable compound (monomer), a photopolymerization initiator, a gelling agent, and a colorant. Of these, the photopolymerizable compound is a compound that is polymerizes with the progress of polymerization reaction when irradiated with ultraviolet rays. This polymerization thickens and cures the ink. The photopolymerization initiator is a compound for initiating the polymerization reaction. The gelling agent is a compound that dissolves in the ink and transforms the ink into a sol when the ink is heated to a temperature higher than or equal to the solation temperature, and forms a crosslinked structure or forms a fibrous aggregate and transforms the ink into a gel when the ink is cooled to a temperature lower than or equal to the gelation temperature. The colorant contains a pigment or dye of a color related to the ink.

The ultraviolet radiator 63 includes a light emitting unit disposed across the width of the conveyor belt 13 in the width direction, and irradiates the recording medium M that is placed on the outer peripheral surface of the conveyor belt 13 and conveyed with ultraviolet rays from the light emitting unit, so that the ink ejected onto the recording medium M is cured and fixed. The light emitting unit of the ultraviolet radiator 63 is opposed to the conveyor belt 13 and is located downstream from the head units 21 in the conveyance direction.

The medium discharge unit 40 includes a plate-shaped discharge tray 41 on which the recording medium M delivered from the conveyor 10 is placed, and stores the recording medium M that has been subject to image recording until it is taken out by the user. The discharge tray 41 may be configured to be movable in the up and down direction, and may adjust the amount of the recording medium M dropping from the height of the support surface of the support and suction unit 15, within an appropriate range.

A delivery unit provided with a roller or belt for delivering the recording medium M to the medium discharge unit 40 in a safer and more reliable manner may be provided between the conveyor 10 and the medium discharge unit 40. For example, a belt bridged between two rollers may be provided so as to guide the recording medium M that has passed above the guide roller 16 to above the uppermost recording medium M on the discharge tray 41.

FIG. 2 is a block diagram showing the main functional configuration of the inkjet recording apparatus 1.

The inkjet recording apparatus 1 includes a controller 50, a support and suction unit 15 having a suction controller 61 and a suction fan 155, head units 21 having a head controller 62 and a recording head 22, an ultraviolet radiator 63, a conveyance controller 64, a communicator 65, and a bus 66.

The controller 50 is a processor that has control over the operation of the inkjet recording apparatus 1. The controller 50 includes a central processing unit (CPU) 51, a random access memory (RAM) 52, a read only memory (ROM) 53, and a storage 54.

The CPU 51 reads various control programs and setting data stored in the ROM 53, stores them in the RAM 52, and executes the programs to perform various arithmetic processes.

The RAM 52 provides a working memory space for the CPU 51 and stores temporary data. The RAM 52 may include a nonvolatile memory.

The ROM 53 stores various control programs executed by the CPU 51, setting data, and the like. The ROM 53 may be replaced with a rewritable nonvolatile memory such as an electrically erasable programmable read only memory (EEPROM) or a flash memory.

The storage 54 stores image data to be recorded and job data including operation settings related to an operation of recording the image data input from an external device via the communicator 65. The storage 54 may be, for example, a hard disk drive (HDD) and may be used together with a dynamic random access memory (DRAM) or the like.

The suction controller 61 rotates the suction fan 155 of the support and suction unit 15 at a rotation speed according to a control signal from the controller 50.

The head controller 62 outputs various control signals and image data to a head drive unit in the recording head 22 in an appropriate timing according to the control signal from the controller 50, so that ink is ejected from the openings in the nozzle of the recording head 22.

The conveyance controller 64 controls the operation of the conveyance motor 111 according to the control signal supplied from the controller 50 to rotate the driver roller 11 and convey the recording medium M through the conveyor belt 13 at an appropriate speed. The conveyance controller 64 supplies a drive signal to a motor for operating the medium supply unit 30 based on a control signal supplied from the controller 50, thereby supplying the recording medium M to the conveyor 10.

The communicator 65 transmits and receives information by communicating with an external device. The communicator 65 performs communication control conforming to various communication standards related to wired or wireless communication by LAN. The received data contains the aforementioned job data. The transmitted data contains status information related to the progress of the image recording operation according to the job data.

The bus 66 is a path for transmission and reception of signals between the controller 50 and other components.

Next, the configuration of the support and suction unit 15 will be described in detail.

Figure 3:
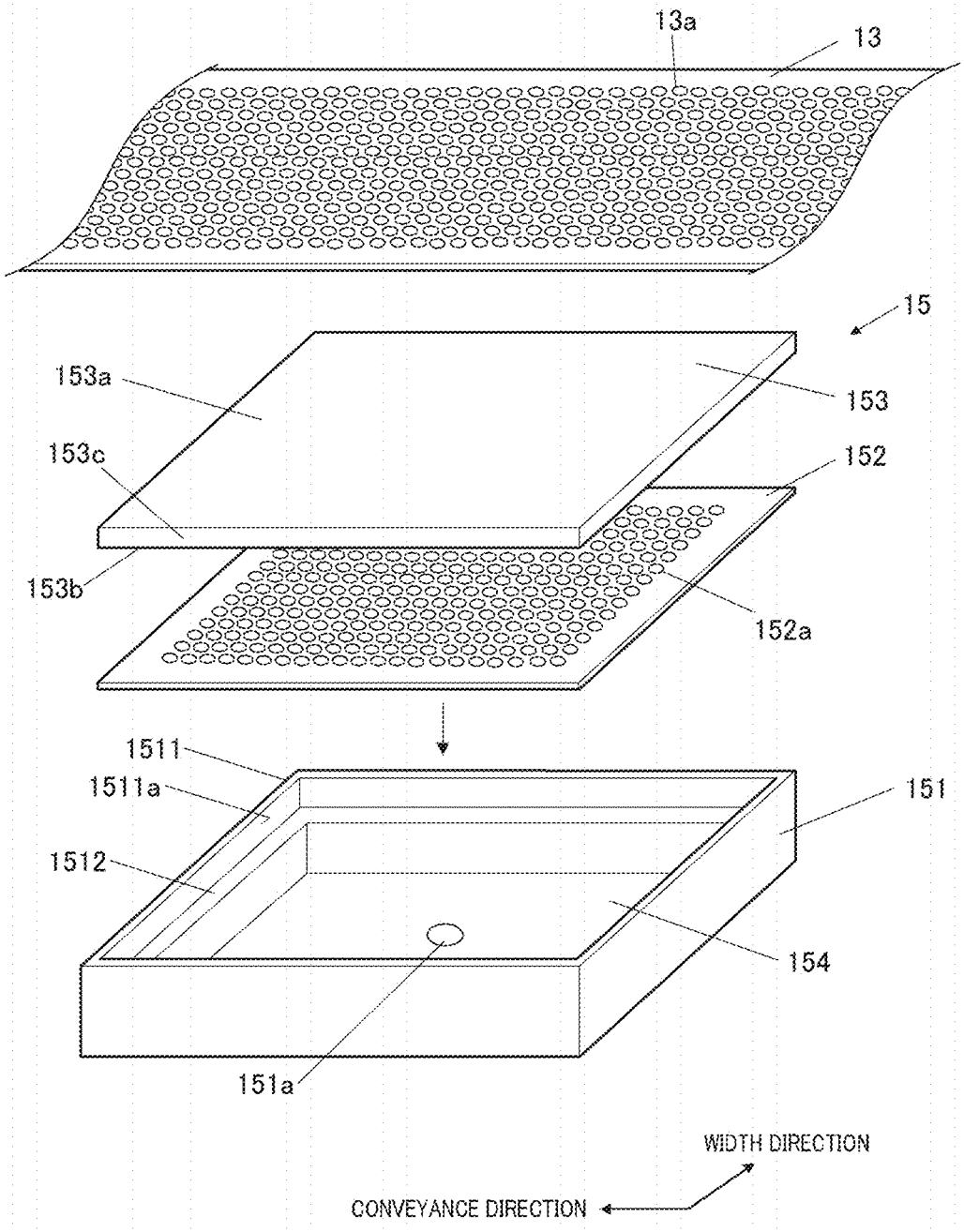
FIG. 3 is an exploded perspective view showing the configuration of a support and suction unit.

FIG. 3 is an exploded perspective view showing the configuration of the support and suction unit 15.

Figure 4:
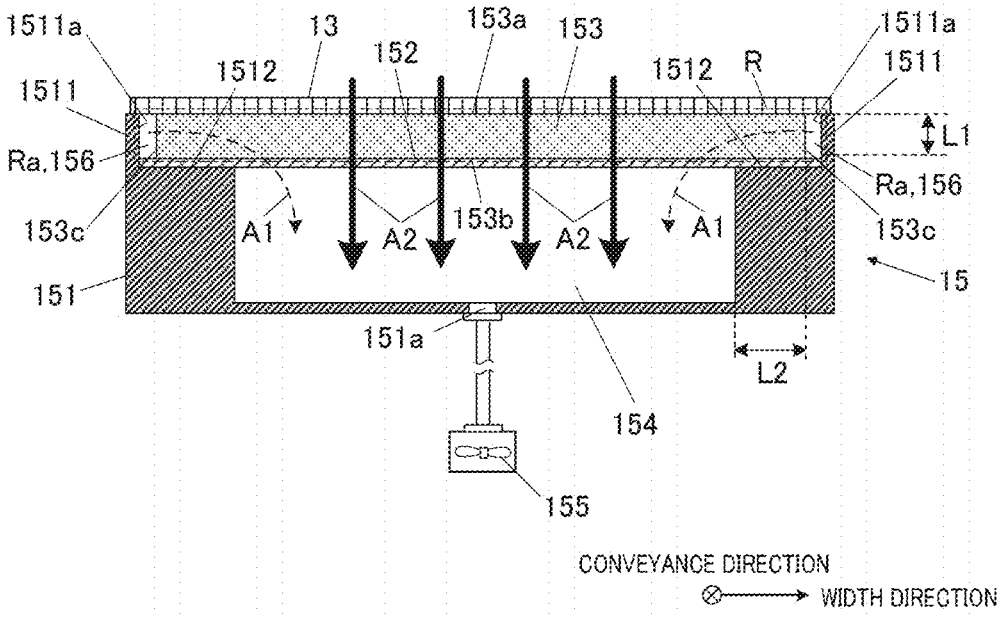
FIG. 4 is a diagram showing a cross section perpendicular to the direction of the conveyance of the support and suction unit.

FIG. 4 is a diagram showing a cross section perpendicular to the direction of the conveyance of the support and suction unit 15.

The support and suction unit 15 includes a housing 151 having a rectangular parallelepiped shape that is opened at the upper side (one side adjacent to the conveyor belt 13), a support plate 152 and a porous body (porous) 153 (ventilation member) laminated to close the upper side of the housing 151, and a suction fan 155 (suction unit) that sucks air in an air chamber 154 provided inside the housing 151.

The housing 151 is formed using a plate of a metal, such as stainless steel or an aluminum alloy, having a thickness of about one to several millimeters. The housing 151 has a shape in which a bottom plate constituting the bottom surface and four side plates constituting four side surfaces connected to the bottom surface are joined. Note that a part or all of the bottom plate and the four side plates may be formed by deforming a single member.

Although FIG. 3 shows an example in which the bottom surface of the housing 151 is substantially square, the shape of the housing 151 is not limited to that shown in FIG. 3 and can be changed as appropriate according to the size, change, and the like of the recording medium M to be conveyed by the conveyor 10.

Portions of the four side plates extending to a predetermined distance from the bottom plate are thick enough to project toward the inside of the housing 151, and the upper surfaces of the portions that project (hereinafter referred to as projecting portions) form a horizontal shelf portion 1512. The support plate 152 and the porous body 153 are supported by the shelf portion 1512. With such a configuration, in the housing 151, the air chamber 154 is formed in a space surrounded by the bottom surface of the housing 151, the four projecting portions, and the porous body 153.

Of the four side plates, the portions above the shelf portion 1512 (the portions adjacent to the conveyor belt 13) are thinner than the projecting portions and define a side wall 1511 (side wall member) having a side wall surface 1511*a* covering the side surface 153*c* of the porous body 153. Here, the side surface 153*c* of the porous body 153 is a surface serving as a joint between the upper surface 153*a* (the surface in contact with the conveyor belt 13) (a first surface) and the lower surface 153*b* (the surface adjacent to the air chamber 154) (a second surface) of the porous body 153.

The side wall 1511 is provided at a height slightly lower than the height of the porous body 153 so as not to come into contact with the conveyor belt 13.

Further, the peripheral portion of the lower surface 153*b* of the porous body 153 excluding the portion overlapping with the air chamber 154 when viewed from the direction perpendicular to the upper surface 153*a* (vertical direction) is in contact with a portion of the support plate 152 which is on the shelf portion 1512 of the housing 151 (on a predetermined member). In other words, the peripheral portion of the porous body 153 is supported by the shelf portion 1512 of the housing 151 via the support plate 152.

The support plate 152 is a plate member formed using a plate composed of a metal, such as stainless steel or an aluminum alloy, and is placed and fixed on the shelf portion 1512 so that it is parallel to the bottom surface of the housing 151. Like the conveyor belt 13, the support plate 152 is provided with a large number (a plurality) of circular air holes 152*a* so as to have an aperture ratio of about 50% so that air can pass therethrough. In FIG. 4, the holes 13*a* of the conveyor belt 13 and the air holes 152*a* of the support plate 152 are not shown.

The material and thickness of the support plate 152 (3 mm in this embodiment) are set so that the rigidity of the support plate 152 is greater than the rigidity of the porous body 153. The rigidity in this case corresponds to a difficulty in deforming (curving) by applying external force including a component in the thickness direction to the support plate 152 and the porous body 153. Hence, the warpage of the porous body 153 during the suction of air by the suction fan 155 is suppressed.

The porous body 153 is a plate-like and rectangular parallelepiped member having a thickness of about 10 mm and placed on the support plate 152. The upper surface 153*a* of the porous body 153 constitutes a support surface that supports the conveyor belt 13. With the conveyor belt 13 supported by the upper surface 153*a* of the porous body 153, the recording medium M delivered in the horizontal direction from the medium supply unit 30 can be placed without moving in the vertical direction and slide on this porous body 153.

The longer the porous body 153 (support and suction unit 15) in the conveyance direction, the easier it is to stabilize the recording medium M during image recording performed by the image recorder 20, but the larger the area occupied in the horizontal direction. Accordingly, the support and suction unit 15 including the porous body 153 has an appropriate length and preferably has, for example, approximately the same length as the length of the recording medium M in the conveyance direction (if a single size is used, based on the single size, and if recording media M in multiple sizes can be subject to image recording, based on a standard length or a maximum length).

The porous body 153 may be, for example, a plate member produced by sintering particles of a resin such as polyethylene resin, fluororesin, or polypropylene resin. Such a porous body 153, which has a mesh-like ventilation paths that are three-dimensionally connected therein, has air permeability in three dimensions, that is, air permeability in the conveyance direction, the width direction, and the vertical direction (the direction perpendicular to the conveyance direction and the width direction).

Accordingly, the air chamber 154 provided on the opposite side of the porous body 153 from the side adjacent to the conveyor belt 13 has air permeability to/from the outer peripheral surface side of the conveyor belt 13 through the holes 13*a* provided in the conveyor belt 13, the porous body 153, and the air holes 152*a* in the support plate 152.

In addition, the porous body 153 of the aforementioned material has lower frictional resistance with the conveyor belt 13 than the support plate 152, and can suppress damage to the conveyor belt 13 and reduce the load on the conveyance motor 111 compared with the case where the conveyor belt 13 is directly supported on the support plate 152 without the porous body 153. Moreover, since the frictional resistance is low as described above, the generation of wear powder upon sliding of the conveyor belt 13 on the porous body 153 can be reduced to a tiny amount.

A suction hole 151*a* that passes through the bottom plate is formed in the bottom surface of the housing 151, and a suction fan 155 is attached to a duct connected to the suction hole 151*a*. The rotation of the suction fan 155 is controlled by the suction controller 61. The suction fan 155 sucks the air in the air chamber 154 connected through the duct and discharges the air to the outside, and generates negative pressure in the air chamber 154 so that the air adjacent to the outer peripheral surface of the conveyor belt 13 is taken into the air chamber 154. In other words, the suction fan 155 sucks the air on the outer peripheral surface side of the conveyor belt 13 through the holes 13*a* of the conveyor belt 13, the porous body 153, the air holes 152*a* of the support plate 152, and the air chamber 154, and attracts the recording medium M placed on the conveyor belt 13 onto the outer peripheral surface.

As shown in FIG. 4, in the support and suction unit 15, a gap 156 (a first gap) is provided between the side surface 153*c* of the porous body 153 and the side wall surface 1511*a* of the housing 151. In other words, the gap 156 as a buffer region Ra that is not provided with the porous body 153 is included in a rectangular ventilation member-disposed region R enclosed by straight lines passing through the upper surface 153*a* and lower surface 153*b* of the porous body 153, and the pair of side wall surfaces 1511*a*, in an arbitrary cross section (for example, the cross section shown in FIG. 4) that intersects the pair of side wall surfaces 1511*a* across the porous body 153 and is perpendicular to the upper surface 153*a* of the porous body 153. The buffer region Ra is provided in a partial region of the ventilation member-disposed region R in the direction along the upper surface 153*a* of the porous body 153 in the aforementioned cross section (in FIG. 4, the width direction).

With the gap 156 (buffer region Ra) provided in this manner, the warpage of the porous body 153 caused when the porous body 153 is thermally expanded is suppressed. This operation will be described below.

The porous body 153 made of the material described above has a greater coefficient of thermal expansion than the housing 151, and expands at a greater coefficient of expansion than the housing 151 when the temperature of the porous body 153 rises. The main factors of an increase in the temperature of the porous body 153 include friction with the conveyor belt 13 that circulates. In addition, the temperature of the porous body 153 can be increased by the heat of the head unit 21 including a heater transmitted to the porous body 153.

Figure 5:
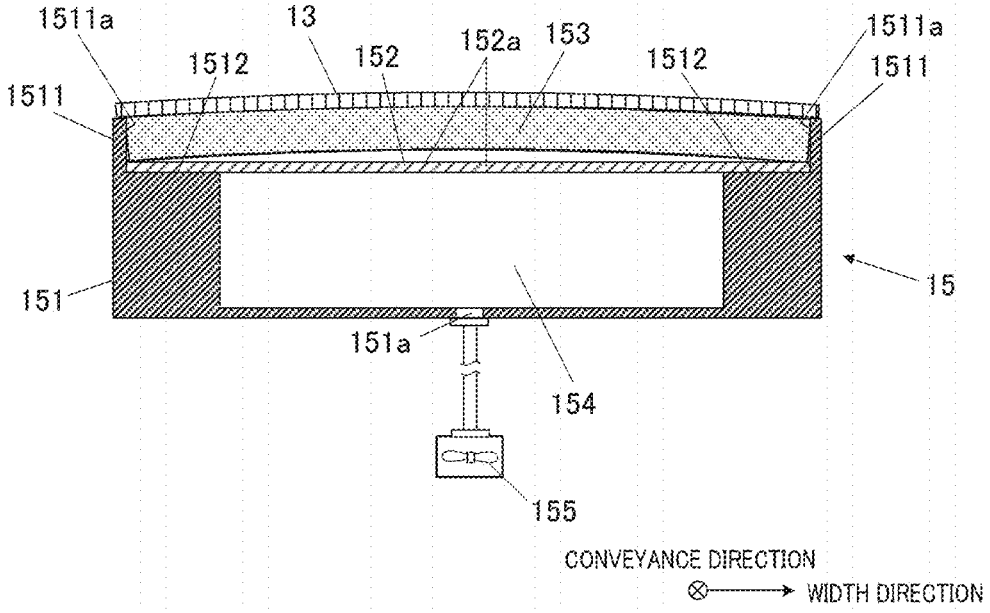
FIG. 5 is a diagram for explaining the problems of the conveyor having a conventional configuration.

Since the porous body 153 expands more easily than the housing 151, in a conventional configuration in which no gap is provided between the porous body 153 and the side wall surface 1511*a* (side wall 1511) of the housing 151, as shown in FIG. 5, when the temperature of the porous body 153 rises and expands, the expansion in the horizontal direction is hindered by the side wall surface 1511*a*, and a convex warpage occurs in the porous body 153 and the flatness of the surface of the conveyor belt 13 is thus impaired. As a result, the attraction of the recording medium M becomes uneven, or the distance between the head unit 21 and the recording medium M becomes inappropriate, so that the image quality of the recorded image decreases.

For this reason, in this embodiment, as shown in FIG. 4, with a gap 156 (buffer region Ra) between the side surface 153*c* of the porous body 153 and the side wall surface 1511*a* of the housing 151, even when the temperature of the porous body 153 rises and expands, the porous body 153 does not come into contact with the side wall surface 1511*a*, and the horizontal expansion of the porous body 153 is not hindered. Hence, the occurrence of the problem that the porous body 153 warps and the flatness of the conveyor belt 13 is impaired is suppressed.

Incidentally, since the upper end of the side wall 1511 and the conveyor belt 13 are slightly separated so as not to come into contact with each other as described above, air can flow into the gap 156 from the outside. For this reason, when a negative pressure is generated in the air chamber 154 by the suction by the suction fan 155, the air can flow into the air chamber 154 along a path extending in the horizontal direction from the gap 156 through the inside of the porous body 153 (the path indicated by the arrow A1 in FIG. 4). If there is a large amount of air flowing along this path, the amount of air inflow in the path indicated by the arrow A2 near the center of the air chamber 154 (near the center of the conveyor belt 13 with respect to the width direction) decreases, and the suction force near the center weakens, which may lead to a failure in the attraction of the recording medium M.

Therefore, in this embodiment, the pressure loss in the path from the side surface 153*c* of the porous body 153 to the air chamber 154 is increased by ensuring a sufficient distance from the side surface 153*c* of the porous body 153 to the air chamber 154, whereby the amount of air inflow in the path indicated by the arrow A1 is made low. To be specific, as shown in FIG. 4, the length L2 from the end of an portion of the lower surface 153*b* of the porous body 153 that overlaps the air chamber 154 to the side surface 153*c* when viewed from the direction perpendicular to the upper surface 153*a* is made larger than the thickness L1 of the porous body 153 in order to make the pressure loss in the path indicated by the arrow A1 sufficiently high. Hence, the amount of air inflow in the path indicated by the arrow A1 is made low, a sufficient amount of air inflow in the path indicated by the arrow A2 near the center of the air chamber 154 is ensured, and a reduction in the attraction of the recording medium M is suppressed.

However, when the distance between the upper end of the side wall 1511 and the conveyor belt 13 is sufficiently small, or when the porous body 153 is composed of a material with which the pressure loss in the path indicated by the arrow A1 is made sufficiently high, the length L2 can be made less than or equal to the thickness L1.

Although the gap 156 is provided between each of the side surfaces 153*c* at both sides of the porous body 153 with respect to the width direction and the side wall surface 1511*a* in the above description, this is not necessarily the case: the gap 156 may be provided between one of the side surfaces 153*c* of the porous body 153 and the side wall surface 1511*a*.

The gap 156 is provided not only at ends with respect to the width direction but also at ends with respect to the conveyance direction. Hence, the expansion of the porous body 153 in the conveyance direction is not hindered.

As described above, the conveyor 10 in the inkjet recording apparatus 1 according to this embodiment includes a loop conveyor belt 13 having an outer peripheral surface on which a recording medium M is placed; a conveyance motor 111 that circulates the conveyor belt 13 along a predetermined circulation path; a porous body 153 provided along at least part of the inner peripheral surface of the conveyor belt 13; an air chamber 154 provided on the opposite side of the porous body 153 from the side in contact with the conveyor belt 13, and has air permeability to/from the outer peripheral surface side of the conveyor belt 13 through the holes 13*a* provided in the conveyor belt 13 and the porous body 153; a suction fan 155 that sucks air in the air chamber 154; and a side wall 1511 having side wall surfaces 1511*a* covering at least part of the side surfaces 153*c* of the porous body 153, in which a buffer region Ra that is not provided with the porous body 153 is included in a ventilation member-disposed region R enclosed by straight lines passing through the upper surface 153*a* and lower surface 153*b* of the porous body 153, and the pair of side wall surfaces 1511*a*, in an arbitrary cross section that intersects the pair of side wall surfaces 1511*a* across the porous body 153 and is perpendicular to the upper surface 153*a* of the porous body 153.

With such a configuration, when the temperature of the porous body 153 increases and causes expansion, the porous body 153 can expand in the horizontal direction (the direction along the upper surface 153*a* of the porous body 153) so as to fill the buffer region Ra. Therefore, the expansion of the porous body 153 in the horizontal direction is not hindered, so that the occurrence of the problem that the expanded porous body 153 warps and the flatness of the conveyor belt 13 is impaired can be suppressed. As a result, the occurrence of the problem that the recording medium M is conveyed while being warped or the attraction of the recording medium M becomes non-uniform can be suppressed, and the recording medium M can be conveyed appropriately. It is also possible to suppress a reduction in the image quality of the recorded image due to an inappropriate distance between the head unit 21 and the recording medium M.

The buffer region Ra includes a gap 156 provided between the porous body 153 and at least one of the pair of side wall surfaces 1511*a*. With such a configuration, when the porous body 153 expands, the porous body 153 is prevented from coming into contact with the side wall surfaces 1511*a*, or the porous body 153 is prevented, when coming into contact with the side wall surfaces 1511*a*, from receiving a drag that is so big that the porous body 153 is warped, from the side wall surfaces 1511*a*.

In addition, the air chamber 154 is provided in the space surrounded by the housing 151 and the porous body 153, a portion of the lower surface 153*b* of the porous body 153 excluding the portion overlapping with the air chamber 154 when viewed from the direction perpendicular to the upper surface 153*a* is in contact with a portion of the support plate 152 which is on the shelf portion 1512 of the housing 151, and, in the aforementioned cross section, the length from the end of an portion of the lower surface 153*b* of the porous body 153 which overlaps with the air chamber 154 to the side surface 153*c* is greater than the thickness of the porous body 153. With such a configuration, the amount of air flowing into the air chamber 154 in the path extending in the horizontal direction from the side surface 153*c* of the porous body 153 to the inside of the porous body 153 can be made small, and a sufficient amount of air inflow, which contributes to the attraction of the recording medium M, near the center of the air chamber 154 can be ensured. This can suppress a reduction in the attraction of the recording medium M.

Further, use of the porous body 153 that has air permeability in three dimensions as a ventilation member enables more efficient ventilation between the outer peripheral surface side of the conveyor 13 and the air chamber 154. In addition, such a configuration in which the side surface 153*c* of the porous body 153 is covered with the side wall 1511 can suppress the inflow of air from the side surface 153*c* of the porous body 153 to the air chamber 154.

In addition, since the inkjet recording apparatus 1 of this embodiment includes the conveyor 10 and the head unit 21 that records an image by applying ink to the recording medium M conveyed by the conveyor 10, the recording medium M can be appropriately conveyed while suppressing the warpage of the porous body 153 in the conveyor 10. A reduction in image quality due to the warpage of the porous body 153 can also be suppressed.

Second Embodiment

The second embodiment of the present invention will now be described. This embodiment is different from the first embodiment in that an elastic member is provided in the buffer region Ra. Points different from those in the first embodiment will be mainly explained below.

Figure 6:
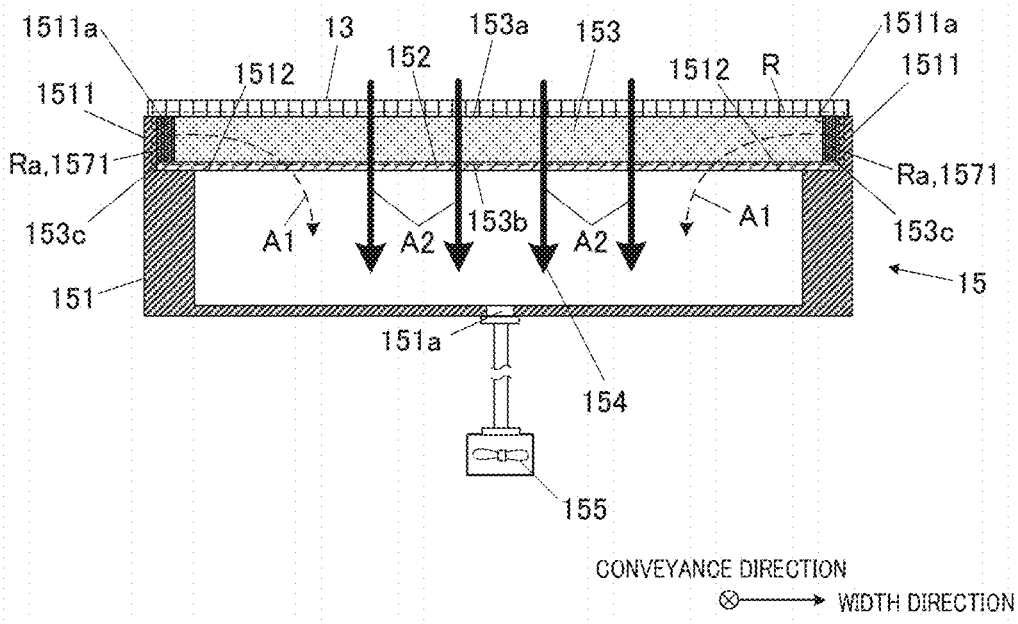
FIG. 6 is a diagram showing a cross section perpendicular to the direction of the conveyance of the support and suction unit of the second embodiment.

FIG. 6 is a diagram showing a cross section perpendicular to the direction of the conveyance of the support and suction unit 15 of the second embodiment.

As shown in FIG. 6, in the support and suction unit 15 of this embodiment, an elastic member 1571 is provided in the gap between the side surface 153*c* of the porous body 153 and the side wall surface 1511*a* of the housing 151. In this embodiment, the region where the elastic member 1571 is provided corresponds to the buffer region Ra.

The elastic member 1571 may be a member having a smaller longitudinal elastic modulus than the porous body 153 (that is, a member having a greater degree of distortion than the porous body 153 when subjected to external stress). Hence, when the porous body 153 expands in the horizontal direction, the elastic member 1571 is compressed in such a manner that the expansion is offset by the force received from the expanded porous body 153.

The elastic member 1571 may be provided with no stress applied from the porous body 153 at normal temperature, or may be provided with stress applied from the porous body 153 at normal temperature so as to urge the porous body 153 and the side wall surface 1511*a* so that they are separated from each other.

The elastic member 1571 may be composed of a material having air permeability, but is preferably composed of a material having airtightness.

Examples of the material of the elastic member 1571 that has a smaller longitudinal elastic modulus than the porous body 153 and has airtightness as described above include resins, such as polyurethane foam, and rubber.

Although the elastic member 1571 is provided between each of the side surfaces 153*c* at both sides of the porous body 153 with respect to the width direction and the side wall surface 1511*a* in FIG. 6, this is not necessarily the case: the elastic member 1571 may be provided between one of the side surfaces 153*c* of the porous body 153 and the side wall surface 1511*a*.

An elastic member 1571 may also be provided in the gap between the side surface 153*c* of the porous body 153 with respect to the conveyance direction and the side wall surface 1511*a*.

As described above, in the inkjet recording apparatus 1 of the second embodiment, an elastic member 1571 is provided in the gap between the side surface 153*c* of the porous body 153 and the side wall surface 1511*a*. Hence, when the temperature of the porous body 153 increases due to friction with the conveyor belt 13 and the porous body 153 expands in the horizontal direction, the elastic member 1571 is compressed in such a manner that the expansion is offset by the force received from the expanded porous body 153, so that the expansion of the porous body 153 in the horizontal direction is not hindered. Consequently, the occurrence of the problem that the expanded porous body 153 warps and the flatness of the conveyor belt 13 is impaired is suppressed. Further, the elastic member 1571 is provided in the gap between the side surface 153*c* of the porous body 153 and the side wall surface 1511*a*, so that the position of the porous body 153 can be prevented from being shifted from a desired position in the horizontal direction.

Further, since the elastic member 1571 is an airtight member, the amount of air inflow in the path that extends to the air chamber 154 through the buffer region Ra and the porous body 153 and is indicated by the arrow A1 is made extremely low, a sufficient amount of air inflow in the path indicated by the arrow A2 near the center of the air chamber 154 is ensured, and a reduction in the attraction of the recording medium M is suppressed.

(Modification 1)

Next, Modification 1 of the second embodiment will be described. Differences from the second embodiment will be described, and description of points that are the same as those of the second embodiment will be omitted below.

Figure 7:
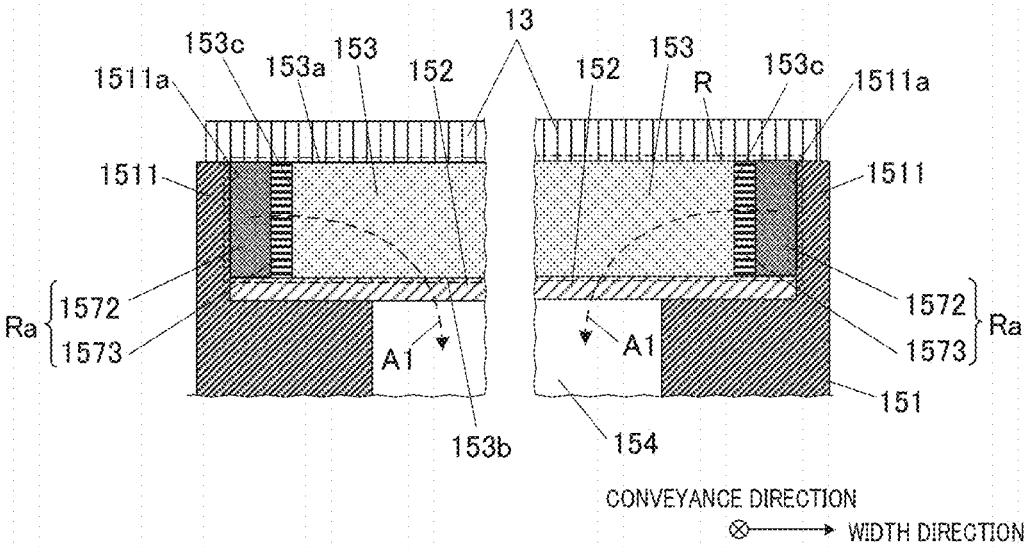
FIG. 7 is a diagram showing a cross section perpendicular to the direction of the conveyance of the support and suction unit of Modification 1, and is an enlarged view of the vicinity of the side surface of a porous body.

FIG. 7 is a diagram showing a cross section perpendicular to the direction of the conveyance of the support and suction unit 15 of Modification 1, and is an enlarged view of the vicinity of the side surface of a porous body 153.

In this modification, an elastic member 1572 is provided in, of the gap (buffer region Ra) between the side surface 153*c* of the porous body 153 and the side wall surface 1511*a*, a portion in contact with the side wall surface 1511*a*, and an airtight member 1573 is provided between the elastic member 1572 and the side surface 153*c* of the porous body 153.

Of these, the airtight member 1573 does not necessarily have elasticity. The airtight member 1573 may be composed of, for example, a metal or a resin such as polyethylene terephthalate (PET).

The elastic member 1572 does not necessarily have airtightness. Therefore, the elastic member 1572 may be a spring member, a sponge, or the like instead of being composed of the same material as the elastic member 1571 of the second embodiment.

As described above, in the conveyor 10 according to Modification 1, the elastic member 1572 and the airtight member 1573 sandwiched between the elastic member 1572 and the porous body 153 are provided in the gap between the side surface 153*c* of the porous body 153 and the side wall surface 1511*a*. With such a configuration, the airtightness of the side surface 153*c* of the porous body 153 can be ensured by the airtight member 1573 while ensuring the elasticity by the elastic member 1572. In other words, since the elastic member 1572 is compressed when the porous body 153 expands in the horizontal direction, the horizontal expansion of the porous body 153 is not hindered. Further, since the airtight member 1573 is provided, the amount of air inflow along the path that is indicated by the arrow A1 in FIG. 7 and extends to the air chamber 154 through the buffer region Ra and the porous body 153 can be made extremely small; therefore, a sufficient amount of air inflow along the path, which contributes to the attraction of the recording medium M, near the center of the air chamber 154 can be ensured, and a reduction in the attraction of the recording medium M can be suppressed.

(Modification 2)

Next, Modification 2 of the second embodiment will be described. Differences from the second embodiment will be described, and description of points that are the same as those of the second embodiment will be omitted below.

Figure 8:
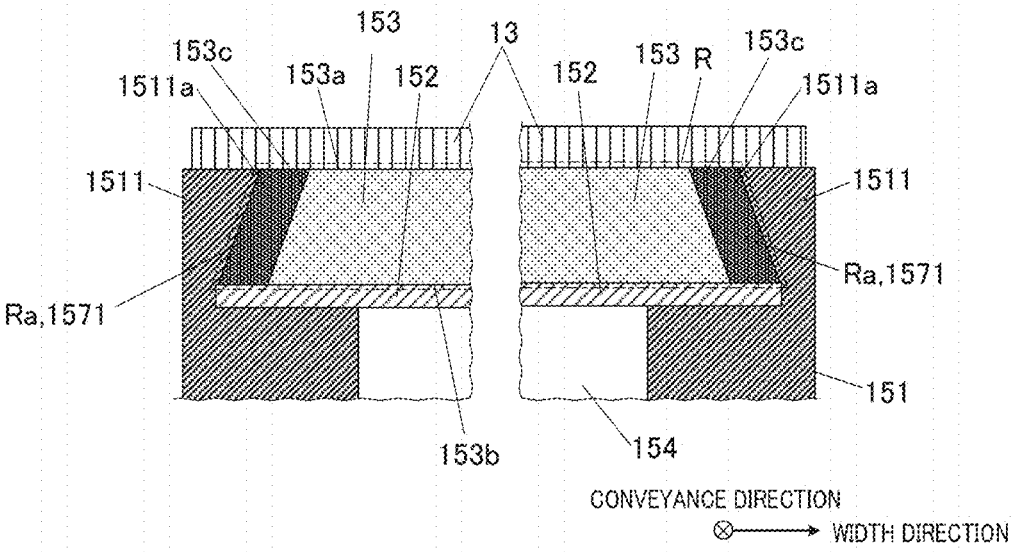
FIG. 8 is a diagram showing a cross section perpendicular to the direction of the conveyance of the support and suction unit of Modification 2, and is an enlarged view of the vicinity of the side surface of a porous body.

FIG. 8 is a diagram showing a cross section perpendicular to the direction of the conveyance of the support and suction unit 15 of Modification 2, and is an enlarged view of the vicinity of the side surface of a porous body 153.

As shown in FIG. 8, in this modification, each of the pair of side wall surfaces 1511*a* across the porous body 153 is inclined with respect to the normal line of the upper surface 153*a* of the porous body 153 so that the distance between the pair of side wall surfaces 1511*a* with respect to the direction along the upper surface 153*a* of the porous body 153 (in FIG. 8, the width direction) increases as the distance from the conveyor belt 13 increases (that is, toward the lower side in FIG. 8). In other words, each side wall surface 1511*a* inclines so that its normal line is directed downward from the horizontal direction.

In addition, the side surface 153*c* of the porous body 153 is inclined with respect to the normal line of the upper surface 153*a* of the porous body 153 so as to be parallel to the side wall surface 1511*a*. In particular, the side surface 153*c* of the porous body 153 facing the side wall surface 1511*a* is inclined so that its normal line is directed upward from the horizontal direction and faces the side wall surface 1511*a*.

An elastic member 1571 composed of the same material as that of the second embodiment is provided in the gap between the side surface 153*c* of the porous body 153 inclined in this way and the side wall surface 1511*a*. Also in this modification, a region of the ventilation member-disposed region R where the elastic member 1571 is provided corresponds to the buffer region Ra.

Alternatively, as in Modification 1 described above, an elastic member 1572 may be provided in a portion, which is in contact with the side wall surface 1511*a*, of the gap between the side surface 153*c* of the porous body 153 and the side wall surface 1511*a*, and an airtight member 1573 may be provided between the elastic member 1572 and the side surface 153*c* of the porous body 153.

As described above, in the conveyor 10 according to the second modification, each of the pair of side wall surfaces 1511*a* is inclined with respect to the normal line of the upper surface 153*a* so that the distance between the pair of side wall surfaces 1511*a* with respect to the direction along the upper surface 153*a* of the porous body 153 increases as the distance from the conveyor belt 13 increases, and the side surface 153*c* of the porous body 153 is inclined with respect to the normal line of the upper surface 153*a* so as to be parallel to the side wall surface 1511*a*. With such a configuration, when the porous body 153 expands in the horizontal direction, the expansion amount on the lower surface 153*b* of the porous body 153 is larger than the expansion amount on the upper surface 153*a*; therefore, when the porous body 153 warps because the side surfaces 153*c* at both ends of the porous body 153 receive a drag, it tends to have a downwardly convex shape. For this reason, the porous body 153 warps upward to a convex shape and pushes the conveyor belt 13 upward, thereby further reducing the risk of the problem that the flatness of the surface of the conveyor belt 13 is impaired.

(Modification 3)

Figure 9:
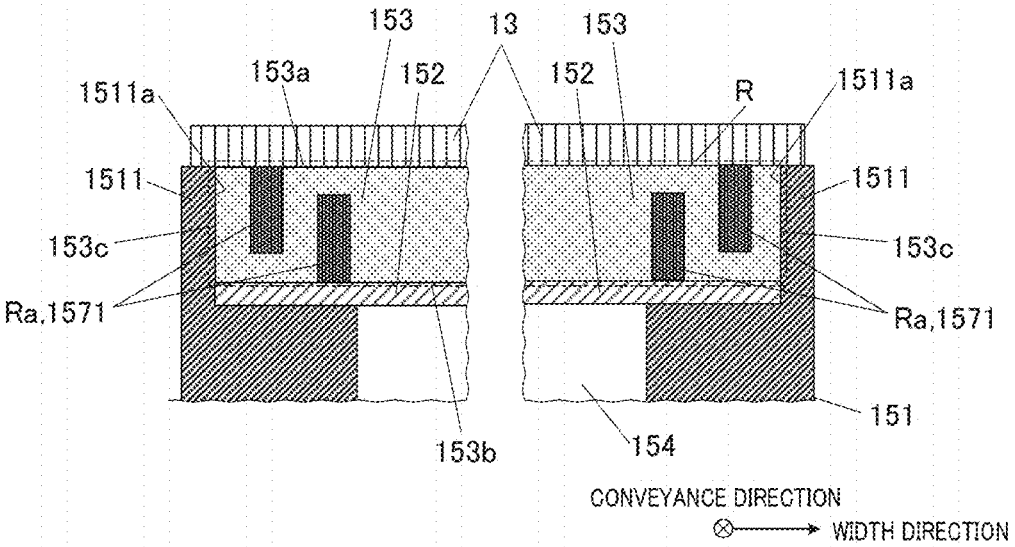
FIG. 9 is a diagram showing a cross section perpendicular to the direction of the conveyance of the support and suction unit of Modification 3, and is an enlarged view of the vicinity of the side surface of a porous body.

Next, Modification 3 of the second embodiment will be described. FIG. 9 is a diagram showing a cross section perpendicular to the direction of the conveyance of the support and suction unit 15 of Modification 3, and is an enlarged view of the vicinity of the side surface of a porous body 153.

As shown in FIG. 9, in this modification, the porous body 153 is provided with grooves extending from the upper surface 153*a* toward the lower surface 153*b* and grooves extending from the lower surface 153*b* toward the upper surface 153*a*, and an elastic member 1571 composed of the same material as that in the second embodiment described above is provided in these grooves. Each groove is provided over the entire length of the porous body 153 along the side surface 153*c* of the porous body 153.

In this modification, a region of the ventilation member-disposed region R described above where the grooves (elastic member 1571) are provided corresponds to the buffer region Ra.

Although there is no particular limitation on the depth of the grooves, the depth of each of the grooves extending from the upper surface 153*a* toward the lower surface 153*b* and the grooves extending from the lower surface 153*b* toward the upper surface 153*a* is desirably ½ or more of the thickness of the porous body 153. Hence, when the porous body 153 expands in the horizontal direction, the expansion of the porous body 153 can be absorbed by compression of the elastic member 1571 in the grooves, at each position with respect to the thickness direction.

Moreover, the directions in which the grooves extend are not limited to the directions perpendicular to the upper surface 153*a* or the lower surface 153*b*, and can be any directions intersecting the upper surface 153*a* or the lower surface 153*b*.

Further, it is desirable to provide the grooves in the porous body 153 within an area that does not overlap with the air chamber 154 when viewed from the direction perpendicular to the upper surface 153*a*. This prevents air inflow into the air chamber 154 in the path that contributes to the attraction of the recording medium M.

Note that it is also possible to provide grooves within an area overlapping with the air chamber 154. This is because even in the region where the grooves (elastic member 1571) are provided, the porous body 153 exists and provides a ventilation function in a part with respect to the thickness direction, so that the recording medium M can be attracted also in that region.

As described above, the buffer region Ra in the conveyor 10 according to Modification 3 has grooves provided in the porous body 153 so as to extend in the direction intersecting the upper surface 153*a*, and the elastic member 1571 is provided in the grooves. With such a configuration, the buffer region Ra can be provided in the ventilation member-disposed region R without dividing the porous body 153. Therefore, the flexibility of the design of the conveyor 10 can be improved more. In addition, even in the region where the elastic member 1571 (grooves) are provided, the porous body 153 exists and provides a ventilation function in a part with respect to the thickness direction, so that the recording medium M can be attracted in the entire region where the porous body 153 is disposed.

(Modification 4)

Next, Modification 4 of the second embodiment will be described.

Figure 10:
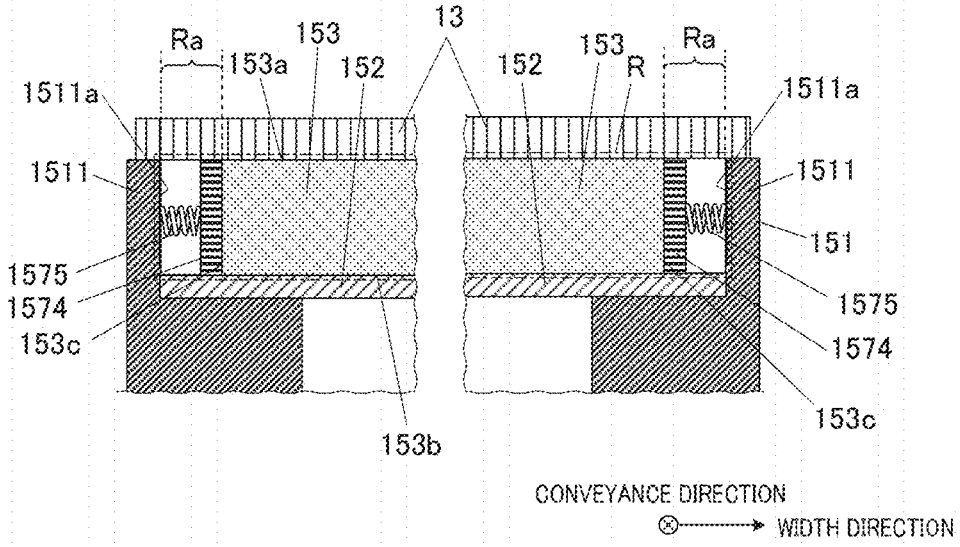
FIG. 10 is a diagram showing a cross section perpendicular to the direction of the conveyance of the support and suction unit of Modification 4, and is an enlarged view of the vicinity of the side surface of a porous body 153.

FIG. 10 is a diagram showing a cross section perpendicular to the direction of the conveyance of the support and suction unit 15 of Modification 4, and is an enlarged view of the vicinity of the side surface of a porous body 153.

In this modification, the elastic member provided in, of the gap (buffer region Ra) between the porous body 153 and the side wall surface 1511*a*, the gap within the area that ultraviolet rays from the ultraviolet radiator 63 can enter is configured as shown in FIG. 10. In other words, a metal plate 1574 (plate member) is in contact with the side surface 153*c* of the porous body 153, and a metal spring member 1575 is provided between the metal plate 1574 and the side wall surface 1511*a*. The spring member 1575 is an elastic member provided in such a manner that it exerts an elastic force on the metal plate 1574 and the side wall surface 1511*a*.

Thus, in this modification, the member provided in the gap between the porous body 153 and the side wall surface 1511*a* is composed of a metal that is not easily deteriorated by ultraviolet rays.

Note that the metal plate 1574 may be replaced with a plate member any other materials resistant to ultraviolet rays. Further, the metal spring member 1575 may be replaced with a spring member composed of any other materials resistant to ultraviolet rays. Examples of member composed of a material resistant to ultraviolet rays include a member composed of a resin or the like and a metal covering the surface of the resin.

Moreover, in the gap between the porous body 153 and the side wall surface 1511*a* and within the area that ultraviolet rays from the ultraviolet radiator 63 do not enter, an elastic member 1571, such as a resin, may be provided as in the second embodiment described above, or the metal plate 1574 and the spring member 1575 may be provided as in FIG. 10.

As described above, in the conveyor 10 according to the modification 4, in the gap between the porous body 153 and the side wall 1511 and within the area that ultraviolet rays from the ultraviolet radiator 63 can enter, the metal plate 1574 and the spring member 1575 each having resistance to ultraviolet rays are provided; the metal plate 1574 is in contact with the side surface 153*c* of the porous body 153; and the spring member 1575 is provided in such a manner that it exerts an elastic force on the metal plate 1574 and the side wall surface 1511*a*. Since all the members provided in the gap between the porous body 153 and the side wall 1511 are composed of materials resistant to ultraviolet rays as described above, the occurrence of the problem that these members deteriorate due to ultraviolet rays from the ultraviolet radiator 63 can be suppressed.

Third Embodiment

The third embodiment of the present invention will now be described. This embodiment is different from the second embodiment in that a plurality of porous bodies 153 are provided. Points different from those in the second embodiment will be mainly explained below.

Figure 11:
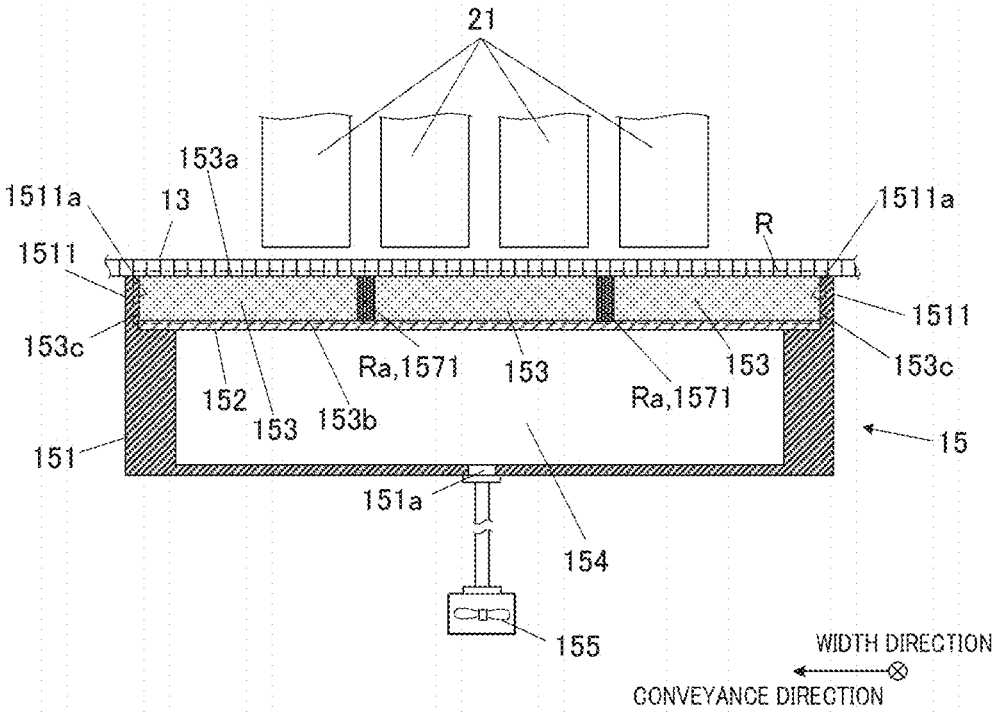
FIG. 11 is a diagram showing a cross section perpendicular to the width direction of the support and suction unit of the third embodiment.

FIG. 11 is a diagram showing a cross section perpendicular to the width direction of the support and suction unit 15 of the third embodiment.

As shown in FIG. 11, in this embodiment, a plurality of (here, three) porous bodies 153 are provided along the inner peripheral surface of the conveyor belt 13. In the example of FIG. 11, three rectangular parallelepiped porous bodies 153 are arranged along the conveyance direction. The arrangement of the porous bodies 153 is not limited to this: the plurality of porous bodies 153 may be arranged in the width direction, or the plurality of porous bodies 153 may be arranged in a matrix in the conveyance direction and the width direction.

In this embodiment, a gap (second gap) between adjacent porous bodies 153 corresponds to the buffer region Ra. In this gap, an elastic member 1571 composed of the same material as that in the second embodiment described above is embedded.

Further, the gap between the porous bodies 153 is provided in an area not overlapping with an area in which ink is applied from the head units 21 onto the recording medium M on the outer peripheral surface of the conveyor belt 13, when viewed from the direction perpendicular to the upper surface 153*a* of the porous body 153. In the example shown in FIG. 11, the gap between adjacent porous bodies 153 and an elastic member 1571 are provided in the region between adjacent head units 21 when viewed from the direction perpendicular to the upper surface 153*a* of the porous body 153.

In this embodiment, a gap may be provided between the porous body 153 and the side wall surface 1511*a* as in the first embodiment, or an elastic member may be provided in the gap between the porous body 153 and the side wall surface 1511*a* as in the second embodiment.

As described above, the conveyor 10 according to the third embodiment includes the plurality of porous bodies 153 provided along the inner peripheral surface of the conveyor belt 13, the buffer region Ra includes the gap between the adjacent ventilation members, and the elastic member 1571 is provided in the gap. With such a configuration, when the plurality of porous bodies 153 expand in the horizontal direction, the elastic member 1571 provided in the gap between the porous bodies 153 is compressed, so that the expansion of the porous body 153 in the horizontal direction is not hindered. Hence, even when a plurality of porous bodies 153 are required to cover the upper opening of the housing 151, for example, when a large-sized conveyor 10 is used, the occurrence of the problem that the porous body 153 warps and the flatness of the conveyor belt 13 is impaired is suppressed.

Further, the gap between the porous bodies 153 is provided in an area not overlapping with an area in which ink is applied from the head units 21 onto the recording medium M on the outer peripheral surface, when viewed from the direction perpendicular to the upper surface 153*a* of the porous body 153. In the position of the gap where the elastic member 1571 is embedded, suction cannot be performed as in the position where the porous body 153 is disposed and the attraction of the recording medium M thus weakens; however, avoiding an overlap between the elastic member 1571 and the area to which ink is applied can suppress a reduction in image quality due to lifting or vibration of a portion of the recording medium M in which ink from the head units 21 lands.

Note that the present invention is not limited to the above embodiments and various modifications can be made.

For example, although an example in which the side wall 1511 of the housing 151 covers the side surface 153*c* of the porous body 153 over the entire circumference has been described in the aforementioned embodiments and modifications, this is not necessarily the case: a section of the side surface 153*c* of the porous body 153 with respect to the longitudinal direction is not necessarily covered with the side wall 1511. Also in this case, if the buffer region Ra is included in the ventilation member-disposed region R in an arbitrary cross section passing through the pair of side wall surfaces 1511*a* across the porous body 153, the horizontal expansion of the porous body 153 is absorbed in the region buffer Ra, thereby suppressing the warpage of the porous body 153.

Although an example in which the porous body 153 has a rectangular parallelepiped shape has been described in the aforementioned embodiments and modifications, this is not necessarily the case. In other words, the shape of the porous body 153 is a plate shape, and the shapes of the upper surface 153*a* and the lower surface 153*b* are not limited to a rectangle. For example, the upper surface 153*a* and the lower surface 153*b* may have a shape other than a rectangle, for example, a polygon, a circle, or an ellipse.

Although an example in which the porous body 153 (porous) is used as a ventilation member has been described in the aforementioned embodiments and modifications, the porous body 153 may be replaced with a member having air permeability in three-dimensions, for example, a plate member provided with air holes extending in the width direction, the conveyance direction, and the thickness direction.

Alternatively, a member that has air permeability in the thickness direction may be used as a ventilation member. In this case, air inflow from the side surface of the ventilation member does not occur, but a side wall 1511 is provided to the housing 151 in order to prevent a horizontal displacement of the ventilation member.

Although an example in which the side wall 1511, which is a part of the housing 151, covers the side surface 153*c* of the porous body 153 has been described in the aforementioned embodiments and modifications, this is not necessarily the case: a side wall member separate from the housing 151 may cover the side surface 153*c* of the porous body 153.

Alternatively, the inside of the housing 151 may be divided into a plurality of air chambers by a partition plate, and the air in each air chamber may be sucked with separate suction force. With such a configuration, the recording medium M can be attracted to the outer peripheral surface with a desired attraction force distribution by adjusting the force of suction of the air from each air chamber. For example, increasing the attraction force at the end of the recording medium M can more reliably suppress the lifting of the end of the recording medium M.

When the porous body 153 has rigidity high enough not to warp when air is sucked by the suction fan 155, the support plate 152 may be omitted.

The present invention may be applied to a conveyor that conveys the recording medium M by rotation of a cylindrical conveyor drum used as a mount member. In such a conveyor, the support and suction unit 15 (the porous body 153 and the air chamber 154) is provided along the curved surface (inner peripheral curved surface) opposite from the outer peripheral curved surface of the conveyor drum. In this case, the support and suction unit 15 and the conveyor drum may be made in one piece so that the support and suction unit 15 is rotated together with the conveyor drum, and the recording medium M may be placed in a predetermined position corresponding to the support and suction unit 15 on the conveyor drum.

Although a sheet (cut sheet) has been taken as an example of a recording medium M in the aforementioned embodiments and modifications, this is not necessarily the case: a long recording medium such as a recording medium unwound from a roll or a continuous sheet may be used.

Although the inkjet recording apparatus 1 using the single-pass system has been taken as an example in the aforementioned embodiments and modifications, the present invention may be applied to an inkjet recording apparatus that records an image while sweeping head units or recording heads.

Although the inkjet recording apparatus 1 has been described as an image recording apparatus in the aforementioned embodiments and modifications, this is not necessarily the case. For example, the present invention can be applied to a dry electrophotographic image recording apparatus that forms an image using toner particles as a color material on a photoconductive drum and transfers it to a recording medium, a wet electrophotographic image recording apparatus that uses liquid toner instead of toner particles, and image recording apparatuses using various methods such as a method in which an thin film of ink formed on a belt is transferred to a recording medium. Any image recording apparatus is provided with a conveyor on which a recording medium M to which the color material is applied is placed and conveyed, and the present invention can be applied to this conveyor.

Although several embodiments of the present invention have been described, the scope of the present invention is not limited to the aforementioned embodiments, and includes the scope of the invention described in the claims and the equivalents thereof.

The entire disclosure of JP 2018-208520A, which is a Japanese patent application filed on Nov. 6, 2018, is incorporated herein by reference in its entirety.

What is claimed is:

1. A recording medium conveying apparatus comprising:

a loop mount member having an outer peripheral surface on which a recording medium is to be mounted;

a driver unit that circulates the mount member along a predetermined circulation track;

a ventilation member provided along at least part of an inner peripheral surface of the mount member;

an air chamber provided on an opposite side of the ventilation member from a side in contact with the mount member, and having air permeability to/from an outer peripheral surface side of the mount member through holes of the mount member and the ventilation member;

a suction unit that sucks air in the air chamber; and a side wall member having side wall surfaces covering at least part of side surfaces of the ventilation member, the side surfaces joining a first surface that is in contact with the mount member and a second surface that is adjacent to the air chamber, wherein a buffer region where the ventilation member is not present is included in a ventilation member-disposed region enclosed by straight lines passing respectively on the first surface, the second surface, and an opposite pair of the side wall surfaces across the ventilation member, in a cross section that intersects the pair of side wall surfaces and is perpendicular to the first surface, and the buffer region is provided in plural such that the buffer regions overlap each other and together cover an entirety of a portion of a side surface of the ventilation member overlapping the side wall member.

2. The recording medium conveying apparatus according to claim 1, wherein the ventilation member is air-permeable in three dimensions.

3. The recording medium conveying apparatus according to claim 1, wherein the buffer region has a groove provided in the ventilation member so as to extend in a direction intersecting the first surface, and an elastic member is provided in the groove.

4. The recording medium conveying apparatus according to claim 1, wherein the buffer region includes a first gap provided between the ventilation member and at least one of the pair of side wall surfaces.

5. The recording medium conveying apparatus according to claim 4, wherein the air chamber is provided in a space surrounded by a predetermined housing and the ventilation member;

a remaining portion of the second surface excluding a portion overlapping with the air chamber in a view from a direction perpendicular to the first surface is in contact with a predetermined surface of the housing or a predetermined member provided on the predetermined surface; and in the cross section, a length from an end of the portion of the second surface overlapping with the air chamber to the side surfaces is greater than a thickness of the ventilation member.

6. The recording medium conveying apparatus according to claim 4, wherein an elastic member is provided in the first gap.

7. The recording medium conveying apparatus according to claim 6, wherein the elastic member is airtight.

8. The recording medium conveying apparatus according to claim 4, wherein, in the first gap, an elastic member and an airtight member are provided, the airtight member being sandwiched between the elastic member and the ventilation member.

9. The recording medium conveying apparatus according to claim 4, wherein in the first gap, a plate member and a spring member that are each resistant to ultraviolet rays are provided in an area that an ultraviolet ray from a predetermined ultraviolet radiator reaches, the plate member is in contact with the side surface of the ventilation member, and the spring member is provided to apply an elastic force on the plate member and the side wall surfaces.

10. The recording medium conveying apparatus according to claim 4, wherein each of the pair of side wall surfaces is inclined with respect to a normal line of the first surface so that, in the cross section, a distance between the pair of side wall surfaces in a direction parallel to the first surface increases as a distance from the mount member increases, and the side surfaces of the ventilation member are inclined with respect to the normal line of the first surface so as to be parallel to the pair of side wall surfaces.

11. The recording medium conveying apparatus according to claim 1, wherein the ventilation member includes a plurality of ventilation members provided along at least part of the inner peripheral surface, the buffer region includes a second gap between the plurality of adjacent ventilation members, and an elastic member is provided in the second gap.

12. The recording medium conveying apparatus according to claim 11, wherein the second gap is provided in an area not overlapping with an area in which a color material is applied from a predetermined recorder onto a recording medium mounted on the outer peripheral surface in a view from a direction perpendicular to the first surface.

13. An image recording apparatus comprising:

the recording medium conveying apparatus according to claim 1; and a recorder that applies a color material to a recording medium conveyed by the recording medium conveying apparatus, so as to record an image.

14. A recording medium conveying apparatus comprising:

a loop mount member having an outer peripheral surface on which a recording medium is to be mounted;

a driver unit that circulates the mount member along a predetermined circulation track;

a ventilation member provided along at least part of an inner peripheral surface of the mount member;

an air chamber provided on an opposite side of the ventilation member from a side in contact with the mount member, and having air permeability to/from an outer peripheral surface side of the mount member through holes of the mount member and the ventilation member;

a suction unit that sucks air in the air chamber; and a side wall member having side wall surfaces covering at least part of side surfaces of the ventilation member, the side surfaces joining a first surface that is in contact with the mount member and a second surface that is adjacent to the air chamber, wherein a buffer region where the ventilation member is not present is included in a ventilation member-disposed region enclosed by straight lines passing respectively on the first surface, the second surface, and an opposite pair of the side wall surfaces across the ventilation member, in a cross section that intersects the pair of side wall surfaces and is perpendicular to the first surface, wherein the buffer region includes a first gap provided between the ventilation member and at least one of the pair of side wall surfaces, wherein an elastic member is provided in the first gap.

15. A recording medium conveying apparatus comprising:

a loop mount member having an outer peripheral surface on which a recording medium is to be mounted;

a driver unit that circulates the mount member along a predetermined circulation track;

a ventilation member provided along at least part of an inner peripheral surface of the mount member;

an air chamber provided on an opposite side of the ventilation member from a side in contact with the mount member, and having air permeability to/from an outer peripheral surface side of the mount member through holes of the mount member and the ventilation member;

a suction unit that sucks air in the air chamber; and a side wall member having side wall surfaces covering at least part of side surfaces of the ventilation member, the side surfaces joining a first surface that is in contact with the mount member and a second surface that is adjacent to the air chamber, wherein a buffer region where the ventilation member is not present is included in a ventilation member-disposed region enclosed by straight lines passing respectively on the first surface, the second surface, and an opposite pair of the side wall surfaces across the ventilation member, in a cross section that intersects the pair of side wall surfaces and is perpendicular to the first surface, wherein the buffer region has a groove provided in the ventilation member so as to extend in a direction intersecting the first surface, and an elastic member is provided in the groove.

* * * * *